US011317212B2

(12) United States Patent
Otis

(10) Patent No.: US 11,317,212 B2
(45) Date of Patent: Apr. 26, 2022

(54) FLAT PANEL HORN LOUDSPEAKER

(71) Applicant: Matthew Otis, Keswick, VA (US)

(72) Inventor: Matthew Otis, Keswick, VA (US)

( * ) Notice: Subject to any disclaimer, the term of this patent is extended or adjusted under 35 U.S.C. 154(b) by 0 days.

(21) Appl. No.: 17/019,215

(22) Filed: Sep. 12, 2020

(65) Prior Publication Data

US 2022/0086567 A1 Mar. 17, 2022

(51) Int. Cl.
*H04R 7/12* (2006.01)
*H04R 7/04* (2006.01)

(52) U.S. Cl.
CPC ..... *H04R 7/045* (2013.01)

(58) Field of Classification Search
CPC ..... H04R 2440/00; H04R 2440/01; H04R 2440/03; H04R 2440/05; H04R 2440/07; H04R 7/12; H04R 7/122; H04R 7/125
USPC ..... 381/152, 430
See application file for complete search history.

(56) References Cited

U.S. PATENT DOCUMENTS 6,332,029 B1 * 12/2001 Azima ..... B42D 15/022 381/152
6,560,348 B1 * 5/2003 Bachmann ..... H04R 1/06 181/170
6,965,678 B2 * 11/2005 Bank ..... G06F 1/1616 381/152
2002/0141607 A1 * 10/2002 Azima ..... H04R 7/045 381/152
2007/0030985 A1 * 2/2007 Cheung ..... H04R 7/045 381/152
2015/0245122 A1 * 8/2015 Rayner ..... H04R 1/2896 381/152
2015/0365746 A1 * 12/2015 Cheung ..... H04R 9/045 381/152

* cited by examiner

*Primary Examiner* — Suhan Ni

(57) ABSTRACT

A distributed mode actuator (DMA) includes a flat panel extending in a plane and a rigid member(s) extended parallel to the plane. The members are mechanically attached to or glued and/or embedded within the face of the flat panel. All associated members are free to vibrate perpendicular and horizontally to the plane. The DMA also includes a magnet and electrically-conducting coil. The coil and magnet are mechanically coupled to the member or associated member. When the coil is energized, an interaction between a magnetic field of the magnet and a magnetic field from the coil applies a force sufficient to generate vibrations and/or movement perpendicular and horizontally to the plane. The DMA also includes components embedded within and attached to the plane, and indentations within the plane, to facilitate acoustical and vibrational waves.

4 Claims, 5 Drawing Sheets

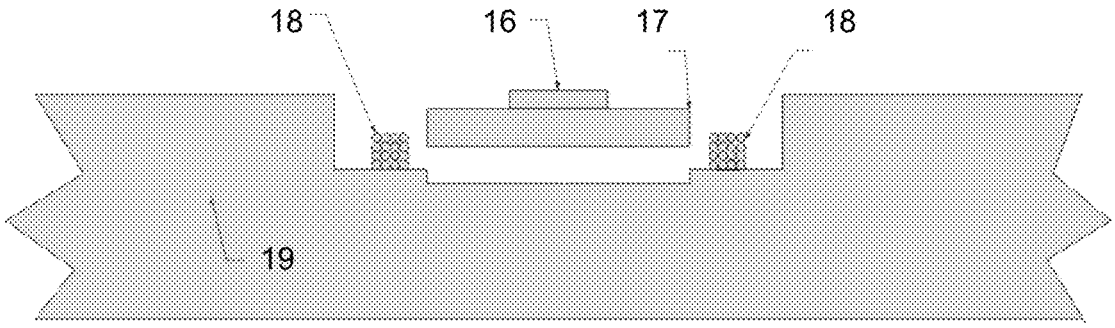
FIG 4
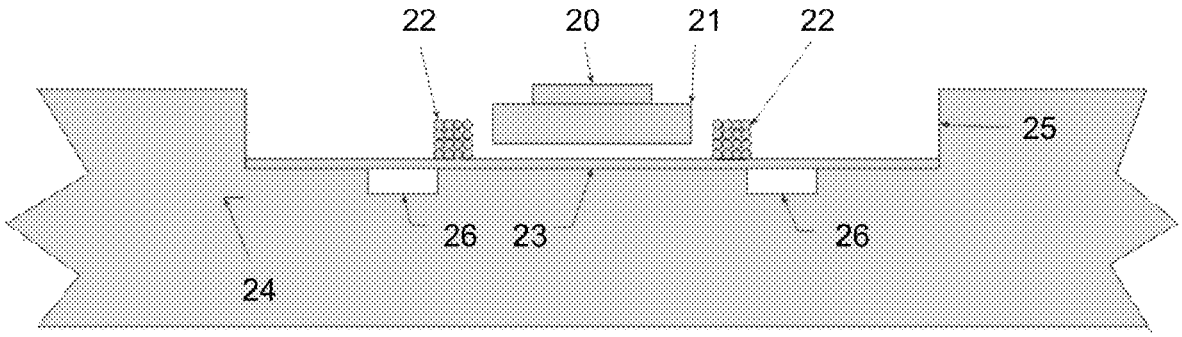
FIG 5 - A

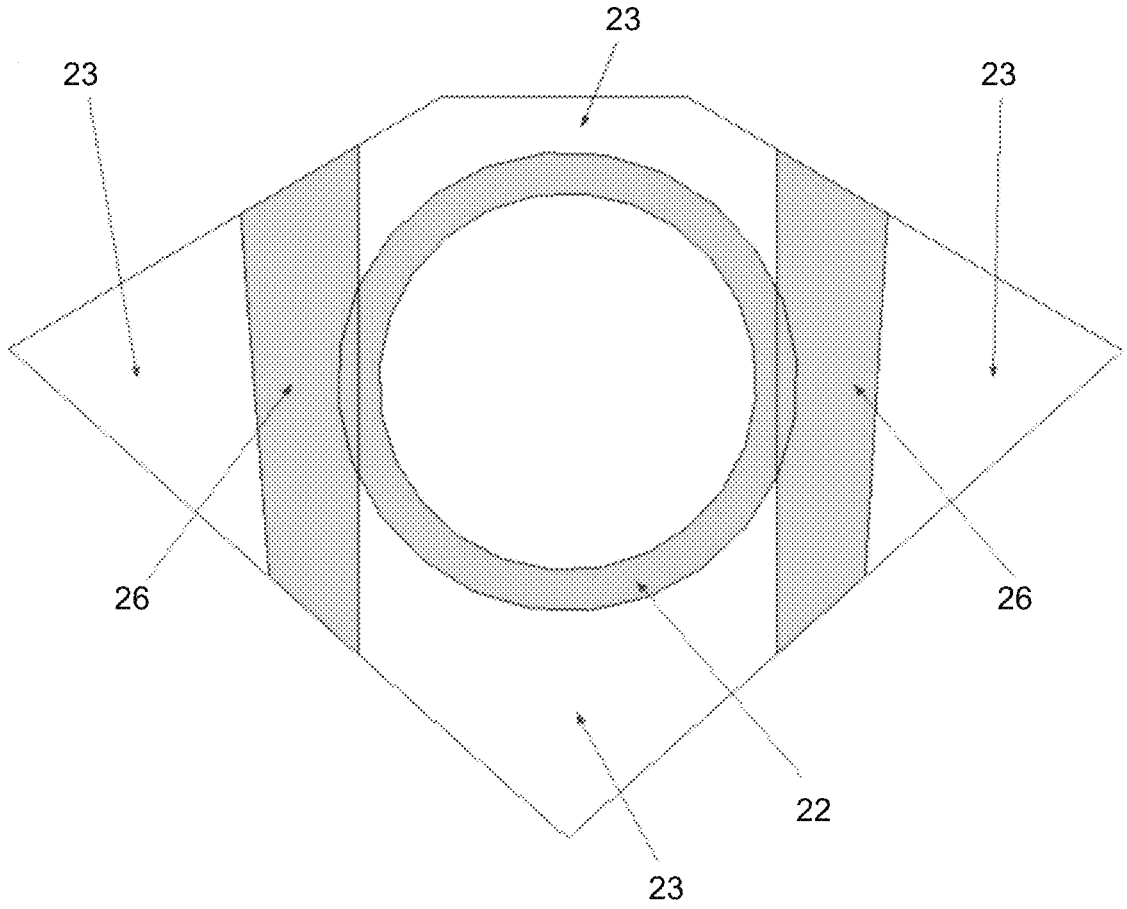
FIG 5 - B

FLAT PANEL HORN LOUDSPEAKER

TECHNICAL FIELD

This disclosure relates generally to a flat panel distributed mode loudspeaker. This specification relates to the magnetic distributed mode actuators (DMAs) and distributed mode loudspeakers (DMLs) with flat panels and magnetic DMAs that are derived from electromagnetic actuators which are coil driven.

BACKGROUND

Many conventional loudspeakers produce sound by inducing piston-like motion in a diaphragm. Flat panel audio loudspeakers, such as distributed mode loudspeakers (DMLs), in contrast, typically operate by inducing distributed vibrational modes in a panel though electro-acoustic actuator(s) which are typically electromagnetic coils and magnets or piezoelectric actuators.

SUMMARY

This specification discloses distributed mode actuators (magnetic DMAs) that include a magnetic circuit which feature one or more electromagnetic coils attached to or within a flat panel and permanent magnets coupled and attached to a single inertial beam. Vibrational modes are excited in the panel and inertial beam by energizing the coil of the magnetic circuit. By attaching the magnet to the inertia beam and the coil to the flat panel, the flat panel and inertial beam can be driven to produce acoustic waves within the flat panel and the subject matter's grooves, indentations and embedded members and the inertial beam.

In general, in the first aspect the invention features a distributed mode loudspeaker which includes a flat panel extending in a plane. The distributed mode loudspeaker also includes a rigid member inertial beam parallel to the plane and mechanically coupled to the face and embedded within the flat panel at and near the end points of the inertial beam, leaving the member inertial beam and panel generally free to vibrate in a direction perpendicular to and horizontally to the plane. The distributed mode loudspeaker further includes magnets and electrically-conducting coils, wherein the electronically-conducting coil is mechanically coupled to the flat panel member and the magnet is attached to the inertial beam and arranged so when the electrically-conducting coil is energized an interaction between the magnetic field of the magnet and magnetic field from the electrically-conducting coil applies a force sufficient to displace the member panel and inertial beam in a direction perpendicular to and horizontally to the plane to vibrate at frequencies and amplitudes sufficient to produce an acoustical response from the flat panel and attached members.

Implementations of the distributed mode loudspeaker can include one or more of the following features and/or features of other aspects, including for example DML flat panel loudspeakers:

A. In some implementations, the electrically-conducting coil is typically attached directly to the flat panel of a distributed mode loudspeaker and the magnet is attached directly to the inertial beam which is attached to the flat panel. The electrically-conducting coil can also be attached to a flat plate which is attached to the flat panel. In some implementations the magnet can be attached to the flat panel and the electrically-conducting coil is attached to the inertial beam which is attached to the flat panel. The complete subject member includes non-magnetic materials. The size, shape, and rigidity of the complete member and attachments can be chosen such that the distributed mode loudspeaker has a resonance frequency from between about 10 Hz to 22,000 Hz.

B. The flat panel of the distributed mode loudspeaker can be composed of an extruded or expanded rigid foam or wood and contains grooves which generally radiate out from the electrically-conducting coils and magnets and can facilitate multiple electrically-conducting coils and magnets with a single inertial beam. The grooves also facilitate the attachment of rigid materials such as flat plates or tubes or rods of carbon fiber or fiberglass or wood or similar material which can be embedded on or within the flat panel to facilitate and enhance the vibrating acoustical waves from the electrically-conducting coils and magnets and inertial beam. The grooves also facilitate the application of coatings which can contain particles derived from metals and jewels, including synthetic jewels. The flat panel also has embedded members to facilitate the attachment of the distributed mode loudspeaker to the wall or to rest on the floor by rods or tubes which are typically composed of wood or fiberglass or carbon fiber or similar material.

Furthermore, the subject matter can be placed closer than one meter but typically within 20 centimeters of a wall or solid surface and generate acoustical waves so that distortion of the acoustical waves arising from the interaction of the close proximity of the wall or solid surface the subject matter is placed near to is minimized. In some implementations the flat panel configuration with the inertial beam and the grooves and embedded material which generally radiate out from the electrically-conducting coils and magnets can be incorporated into flat panel displays, speaker enclosures, vehicles, and electronic devices.

BRIEF DESCRIPTION OF THE DRAWINGS

FIG. 4 is a cut-away perspective view of the subject matter as a distributed mode flat panel loudspeaker showing the device's electrically-conducting coil and magnet and inertial beam which can generate frequencies of 10 Hz to 10 K Hz.

FIG. 5-A is a cut-away perspective view of the subject matter as a distributed mode flat panel loudspeaker showing the device's flat plate and electrically-conducting coil and magnet and inertial beam which can generate frequencies of 200 Hz to 22 K Hz.

FIG. 5-B is a cut-way perspective view of the subject matter as a distributed mode flat panel loudspeaker with the device's electrically-conducting coil which can generate frequencies of 200 Hz to 22 K Hz and the flat plate which the electrically-conducting coil is attached to, and the cavities or indentations beneath the flat plate.

DETAILED DESCRIPTION OF THE DRAWINGS

The disclosure features grooves and indentations and cavities and their embedded or attached structures within the flat panel of a distributed mode loudspeaker with an inertial beam and electrically-conducting coils and magnets. Such arrangements can also be integrated into vehicles, displays, and electronic devices. For a distributed mode flat panel loudspeaker, the electrically-conducting coils and magnets typically have a diameter of 10 mm to 50 mm and a depth of 2 mm to 20 mm. The flat panel has sides which typically form a square, rectangular, or hexagon of which each side of the flat panel is typically of 10 cm to 200 cm in length. The flat panel material typically has a thickness of 25 mm but can also be from about 1 mm to 200 mm thick.

Figure 1:
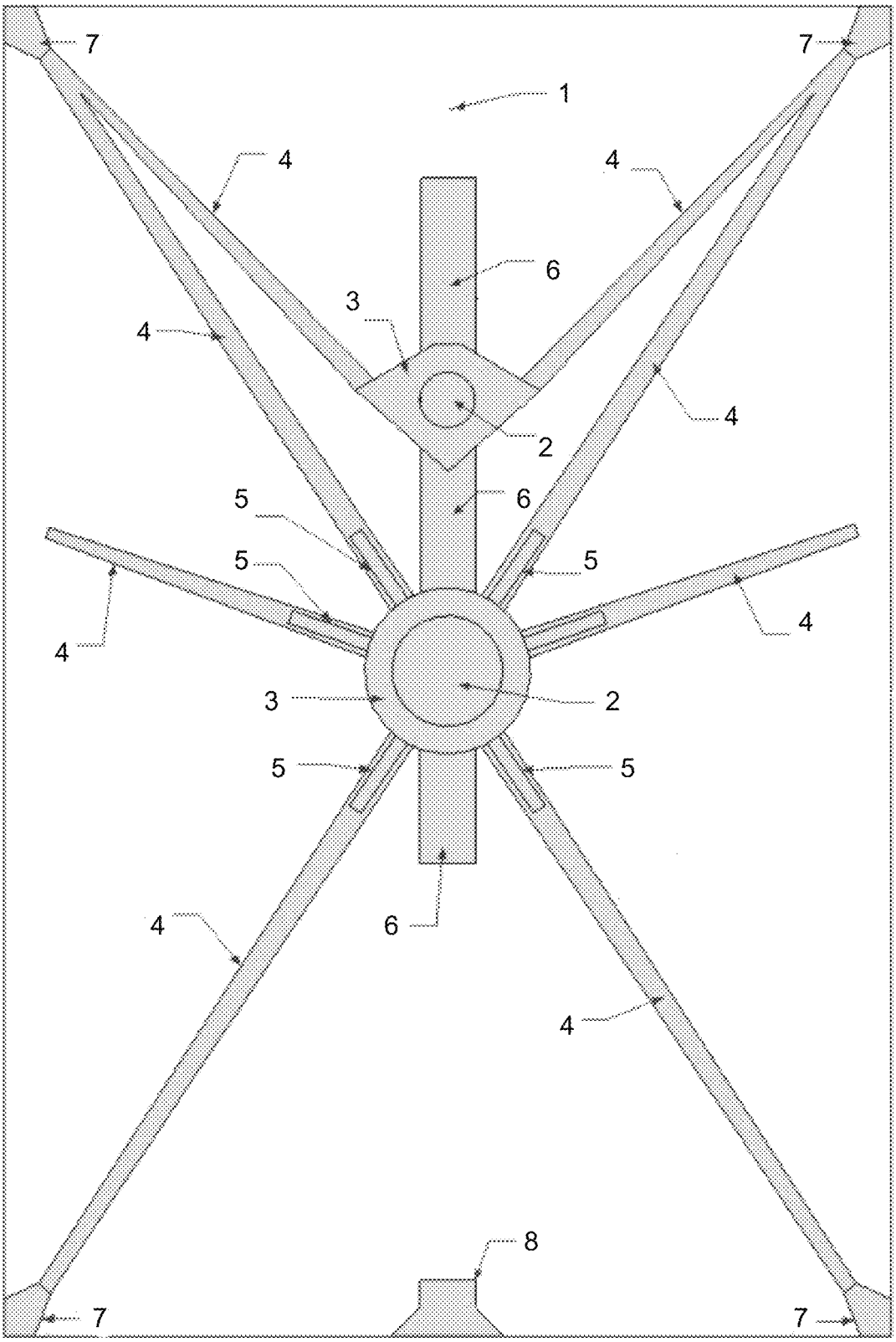
FIG. 1 is a perspective view of the subject matter device as a flat panel distributed mode loudspeaker with the groves and indentations that facilitate the inertial beam, multiple electrically-conducting coils and magnets, and materials embedded in and attached to the flat panel's groves to facilitate vibrating acoustical waves from the electrically-conducting coils and magnets and inertial beam.

FIG. 1 shows the flat panel (1) which is typically composed of extruded or expanded foam or wood with the circular electrically-conducting coil and magnet actuators (2) which are embedded into or within cavities (3) of the flat panel. The groves radiating out from the electrically-conducting coils and magnets (4) are typically about from 1 mm to 24 mm wide and deep and have embedded structures (5) typically composed of carbon fiber, wood or fiberglass which are typically flat plates, tubes, rods or cones with a wall thickness of 0.1 mm to 5 mm and a width of 2 mm to 40 mm and with a length of 3 mm to 200 mm which are in close proximity to the electrically-conducting coils and magnets. The grooves (4,5) typically have epoxy-based coatings which can contain metal and jeweled derived additives such as from titanium and jewels or synthetic jewels. The indentations or cavities (6) which are typically 1 mm to 25 mm in depth facilitate the mechanical or glued connection of and conductance of the acoustical waves, wiring, electrically-conducting coils and magnets, and the inertial beam (12) (shown in FIG. 3) which the electrically-conducting coils and magnets are attached to. The embedded solid material at each corner (7) is typically made of plastic or wood and magnets which facilitates the attachment of the flat panel to the wall or to rest on the floor and further accentuates the sound quality and minimizes distortion of the acoustic reproduction. The wiring from the electrically-conducting coils terminates into the speaker wire terminal posts (8).

Figure 2:
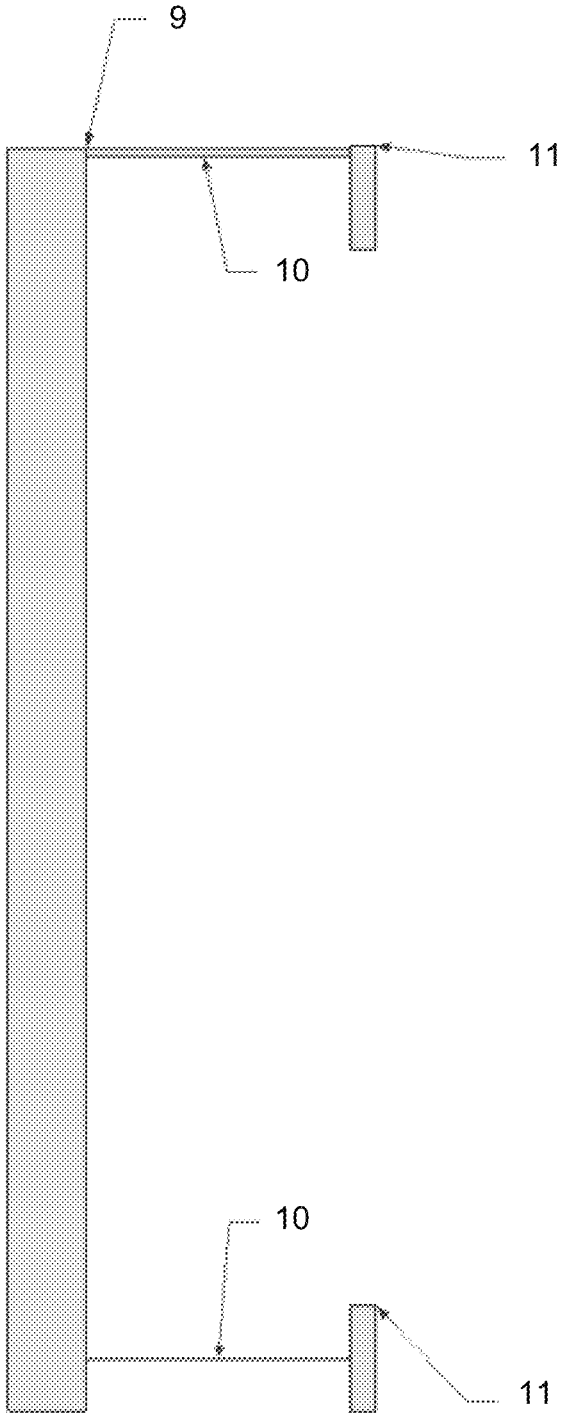
FIG. 2 is a side perspective view of the subject matter device as a distributed mode flat panel loudspeaker with wall and/or floor attachments.

FIG. 2 shows a side view as a distributed mode loudspeaker (9) with the connecting rods which typically contain embedded magnets which are typically formed from carbon fiber or fiberglass or wood (10) with the wall or floor attachments (11).

Figure 3:
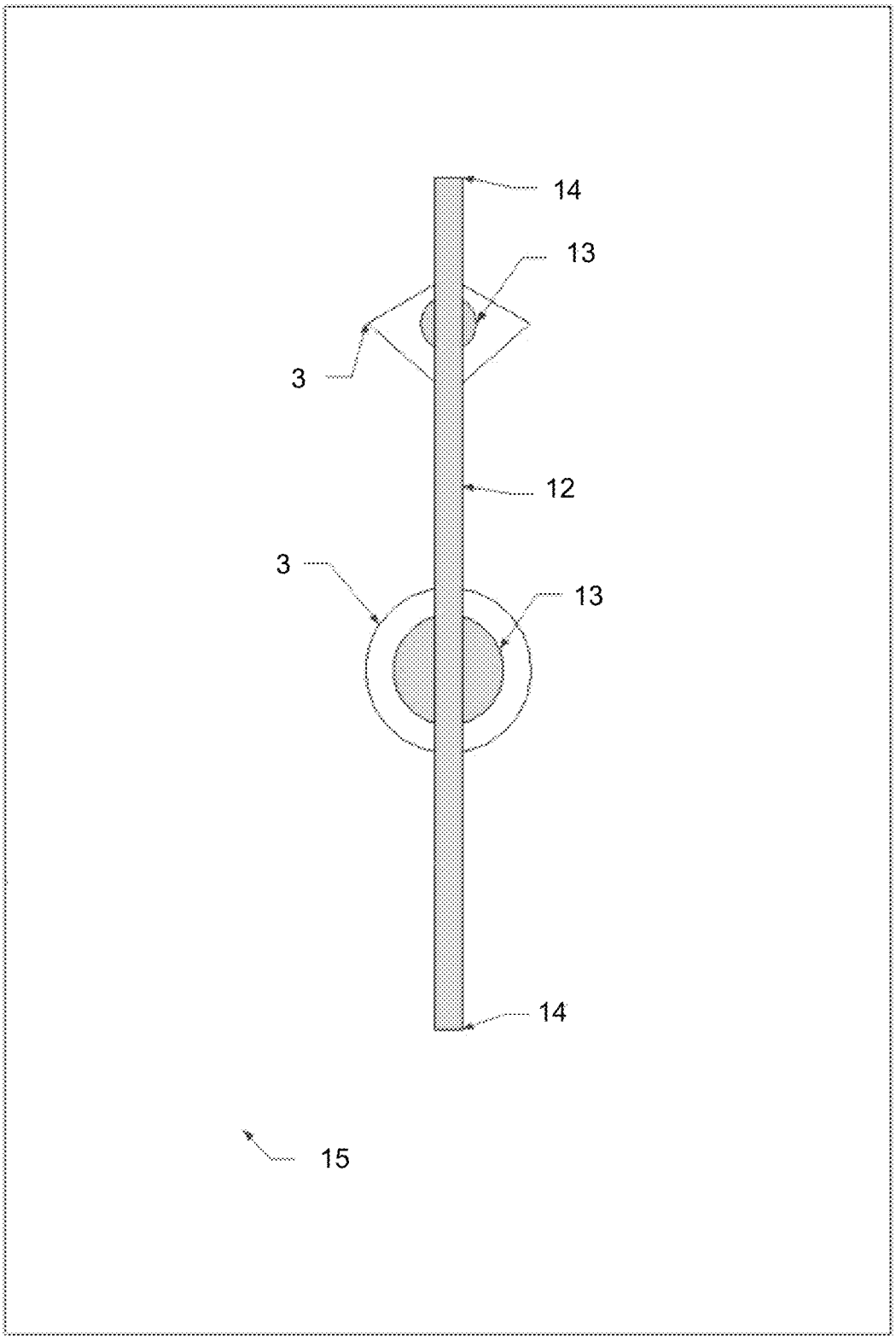
FIG. 3 is a perspective view of the subject matter device as a distributed mode flat panel loudspeaker showing the grooves and indentations and cavities and the inertial beam which facilitates the attachment and suspension of the magnets.

FIG. 3 shows the inertial beam (12) which is typically formed from carbon fiber, fiberglass or wood which in this example is attached to the permanent magnets (13) which are suspended and held within embedded indentations or cavities (3) of the flat panel and suspended and held in close proximity and typically partially within the electrically-conducting coils. The inertial beam (12) typically extends to or near the edges of the flat panel (15), and the inertial beam (12) is typically attached near and to both ends of the inertial beam (14) to the flat panel (15), but is otherwise free-floating to facilitate vibrations to produce acoustical waves both from the inertial beam and by the attachment of both ends of the inertial beam to the flat panel of the distributed mode loudspeaker. The inertial beam is typically 5 mm to 30 mm wide and 1 mm to 15 mm thick and 80 mm to 1000 mm long.

FIG. IV shows a cut-away side view of the inertia beam (16) as it is typically attached to a magnet (17). In this example a magnet (17) is attached by glue to and suspended from the inertial beam so it is held in close proximity and within the electrically-conducting coil (18) which is glued or mechanically attached to the flat panel within a cavity or indentation of the flat panel. The flat panel (19) as shown in this side cut-away view facilitates the typical embedding of the electrically-conducting coil and magnet actuator configuration which can vibrate and generate frequencies of 10 Hz to 22 KHz.

FIG. 5-A shows a cut-away side view of the inertia beam (20) which is attached to a magnet (21). The inertia beam is the same as shown in FIG. 4-16 but FIG. 5-A shows a portion of the inertia beam which is typically 100 mm to 200 mm away from the electrically-conducting coil as shown in FIG. 4-18. In FIG. 5-A the magnet (21) is mechanically attached typically by glue to and suspended from the inertial beam (20) so it is held in close proximity and within the electrically-conducting coil (22) which is typically glued to a flat plate (23) of which is typically glued to the flat panel (24) within a cavity or indentation (25) of the flat panel. The flat panel (24) as shown in this side cutaway view facilitates the typical embedding of the distributed mode actuator's electrically-conducting coil and magnet configuration (21, 22) which typically vibrates and generates frequencies of 100 Hz to 22 K Hz. The flat plate (23) is typically attached to and between the flat panel (24) and the electrically-conducting coil (22). The cavities or indentations (26) within the flat panel (24) underneath the flat plate (23) are typically positioned adjacent to the electrically-conducting coil (22). The flat plate (23) is typically made of a carbon fiber plate which typically contains metal or jeweled derived particles.

FIG. 5-B shows a cut-way top or front perspective view of the same subject matter as shown in FIG. 5-A with the device's electrically-conducting coil (22) which can generate frequencies of 100 Hz to 22 K Hz and the flat plate (23) which the electrically conducting coil (22) is attached to and the typical shape of the cavities or indentations (26) underneath or behind the flat plate (23). The cavities or indentations (26) placed behind or underneath the flat plate (23) are not typically clearly visible in the completed subject matter distributed mode loudspeaker.

What is claimed is:

1. A distributed mode loudspeaker comprising:

a flat panel comprising a rigid material, wherein the rigid material is configured to form a pattern and composition including a plurality of grooves and a plurality of cavities, wherein the plurality of grooves and the plurality of cavities contain a coating and one or more embedded structures, wherein the plurality of grooves and the plurality of cavities are disposed such that a first end of the plurality of cavities is adjacent to a set of electronically activated coils and magnets; and a single inertia bar attached to one or more magnets, wherein the single inertia bar is configured to dispose the one or more magnets adjacent to the set of electrically activated coils.

2. The distributed mode loudspeaker of claim 1, wherein the set of electrically activated coils is attached within a cavity of the flat panel.

3. The distributed mode loudspeaker of claim 1 further comprising a flat plate disposed between the flat panel and the set of electrically activated coils, wherein the cavities are disposed between the flat panel and the flat panel.

4. The distributed mode loudspeaker of claim 3, wherein the flat plate comprises one or more of carbon fiber, metal, or a jeweled particle.

* * * * *